US008454384B2

(12) United States Patent
Islam et al.

(10) Patent No.: US 8,454,384 B2
(45) Date of Patent: Jun. 4, 2013

(54) SLIP RING CONTACT COAXIAL CONNECTOR

(75) Inventors: Nahid Islam, Westmont, IL (US); Al Cox, Orland Park, IL (US)

(73) Assignee: Andrew LLC, Hickory, NC (US)

( * ) Notice: Subject to any disclaimer, the term of this patent is extended or adjusted under 35 U.S.C. 154(b) by 0 days.

(21) Appl. No.: 13/321,613

(22) PCT Filed: Jun. 4, 2010

(86) PCT No.: PCT/US2010/037521

§ 371 (c)(1), (2), (4) Date: Nov. 21, 2011

(87) PCT Pub. No.: WO2010/141905

PCT Pub. Date: Dec. 9, 2010

(65) Prior Publication Data

US 2012/0064768 A1 Mar. 15, 2012

Related U.S. Application Data

(60) Provisional application No. 61/184,573, filed on Jun. 5, 2009.

(51) Int. Cl.
*H01R 9/05* (2006.01)

(52) U.S. Cl.
USPC ..... 439/583

(58) Field of Classification Search
USPC ..... 439/583, 584
See application file for complete search history.

(56) References Cited

U.S. PATENT DOCUMENTS

| | | | | |
|---|---|---|---|---|
| 3,963,320 | A | 6/1976 | Spinner | |
| 4,676,577 | A | 6/1987 | Szegda | |
| 6,217,384 | B1 | 4/2001 | Strasser et al. | |
| 6,793,529 | B1 | 9/2004 | Buenz | |
| 6,994,587 | B2 | 2/2006 | Buenz et al. | |
| 7,347,727 | B2 | 3/2008 | Wlos et al. | |
| 7,462,069 | B2 | 12/2008 | Studerus | |
| 7,607,942 | B1 * | 10/2009 | Van Swearingen | 439/578 |
| 7,803,018 | B1 * | 9/2010 | Islam | 439/583 |
| 7,857,661 | B1 * | 12/2010 | Islam | 439/584 |
| 2002/0031943 | A1 * | 3/2002 | Kanda et al. | 439/583 |
| 2010/0041271 | A1 * | 2/2010 | Van Swearingen et al. | 439/583 |
| 2010/0130060 | A1 * | 5/2010 | Islam | 439/584 |
| 2010/0190377 | A1 * | 7/2010 | Islam | 439/584 |
| 2011/0021074 | A1 * | 1/2011 | Paynter et al. | 439/584 |
| 2011/0201232 | A1 * | 8/2011 | Islam | 439/583 |

* cited by examiner

*Primary Examiner* — Gary F. Paumen
(74) *Attorney, Agent, or Firm* — Babcock IP, PLLC

(57) ABSTRACT

A coaxial connector with a connector body is provided with a connector body bore. An annular coupling groove is provided in the connector body bore open to a cable end of the connector body. A clamp sidewall of the coupling grove is angled inward from a bottom of the coupling groove. A slip ring seated within the coupling body bore is provided with a grip surface. An annular compression body is positioned between the slip ring and a compression surface of the coupling body. The connector body and the coupling body are coupled together via threads. The slip ring is dimensioned for axial advancement of the coupling body along the threads to exert a compression force against the compression body to clamp a leading edge of the outer conductor between the slip ring and the clamp sidewall.

20 Claims, 13 Drawing Sheets

SLIP RING CONTACT COAXIAL CONNECTOR

CROSS REFERENCE TO RELATED APPLICATIONS

This application claims the benefit of U.S. Provisional Patent Application Ser. No. 61/184,573 "Coaxial Connector for Solid Outer Conductor Coaxial Cable" filed Jun. 5, 2009 by Nahid Islam and Al Cox, currently pending and hereby incorporated by reference in its entirety.

BACKGROUND OF THE INVENTION

1. Field of the Invention

The invention relates to electrical connectors for coaxial cable. More particularly the invention relates to a coaxial connector with a slip ring contact which provides a grip and clamp outer conductor electro-mechanical interconnection.

2. Description of Related Art

A positive stop type coaxial connector, for example as disclosed in commonly owned U.S. Pat. No. 6,793,529 titled: "Coaxial Connector with Positive Stop Clamping Nut Attachment", by Larry Buenz, issued Sep. 21, 2004, hereby incorporated by reference in its entirety, has a connector body and a back nut configured for threaded interconnection. As the connector body and back nut are threaded together, a flared leading edge of the outer conductor of the coaxial cable is clamped between the connector body and the coupling body in a secure electro-mechanical interconnection. To indicate proper threading completion and avoid damage to the connector and/or coaxial cable from overtightening, a positive stop between the connector body and the back body may be applied wherein the threading between the back body and connector body bottoms at a specific axial location at which the desired maximum tightening compression/torque force occurs, definitively signaling the installer that the proper amount of tightening has been reached. To allow for thermal expansion cycling and/or variances in manufacture of the connector and/or the outer conductor dimensions, a compression element is inserted between internal contacting surfaces of the outer conductor, back body and/or the connector body. The compression element is typically supplied loose with the coaxial connector prior to installation, which creates a loss and/or damage risk for the compression element.

Prior positive stop type coaxial connector designs typically require flaring of the outer conductor to enable a sandwich clamp action between the connector body, the leading edge of the outer conductor and the back nut. Although a corrugated outer conductor coaxial cable provides a suitable outer diameter grip surface for a user during the flaring procedure, the smooth outer diameter of a smooth wall outer conductor coaxial cable may be difficult to easily grip during flaring.

A current market trend is to replace traditional copper material coaxial cables with aluminum material coaxial cables to save materials cost and lower the weight per unit length of the coaxial cable. Further, smooth wall outer conductor cables provide inherent materials cost and cable weight advantages compared to corrugated outer conductor coaxial cable configurations.

Aluminum has lower mechanical strength properties including cold work properties (bending) compared to copper. Aluminum is susceptible to creep and may weaken at a single contact point with extreme contact pressure due to bending, pulling and/or twisting.

Smooth wall cable is less flexible compared to corrugated cable; however, users used to working with corrugated coaxial cable may not recognize the lower bend capability of smooth wall cable. Users attempting to apply improper bend radii may overstress a conventional coaxial connector and cable interconnection.

Competition within the coaxial cable and connector industry has focused attention upon improving electrical performance as well as reducing manufacturing, materials and installation costs.

Therefore, it is an object of the invention to provide a method and apparatus that overcomes deficiencies in such prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention. For clarity, similar elements between different embodiments utilize the same notations and some notations appearing on the different figures may not be specifically identified on each figure.

DETAILED DESCRIPTION

Figure 1:
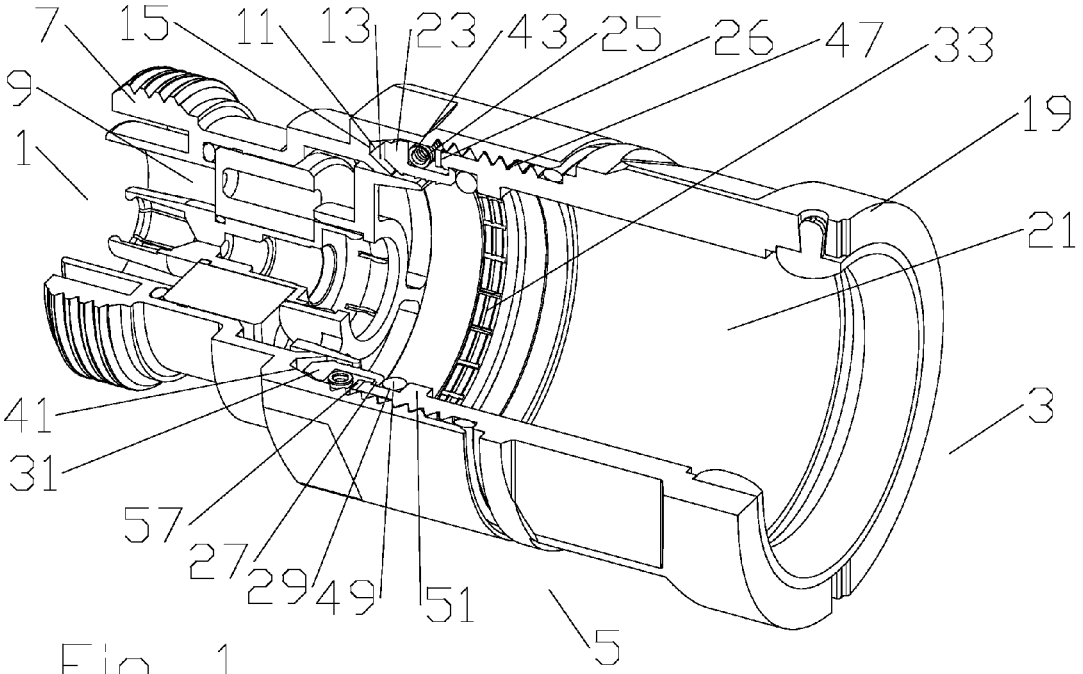
FIG. 1 is a schematic 90 degree cut-away side view of a first embodiment of a coaxial connector.
Figure 2:
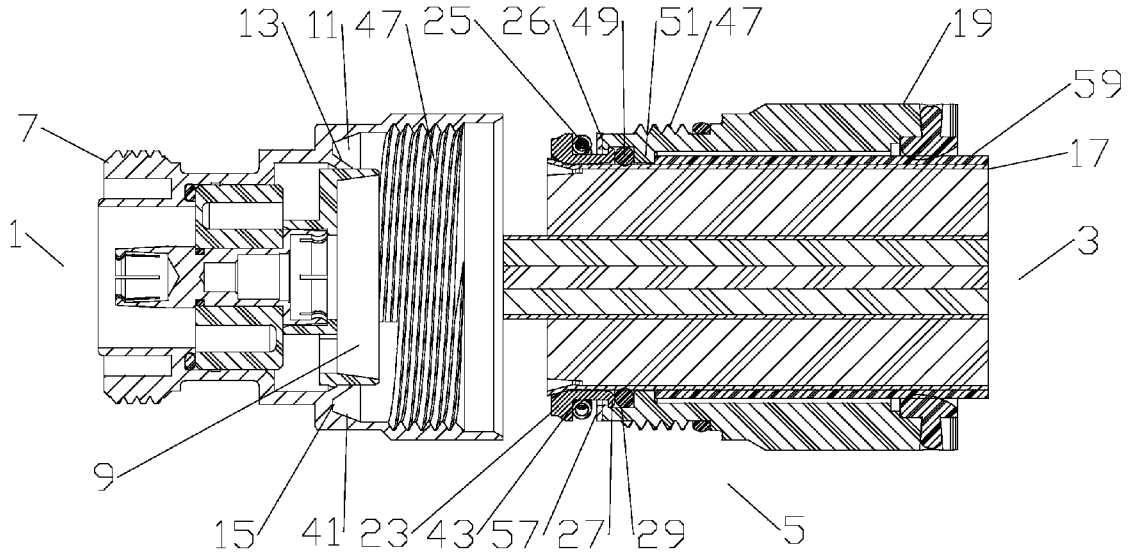
FIG. 2 is a schematic 90 degree cut-away side view of the first embodiment coaxial connector of FIG. 1 with a coaxial cable inserted, ready for coupling of coupling body to connector body.
Figure 3:
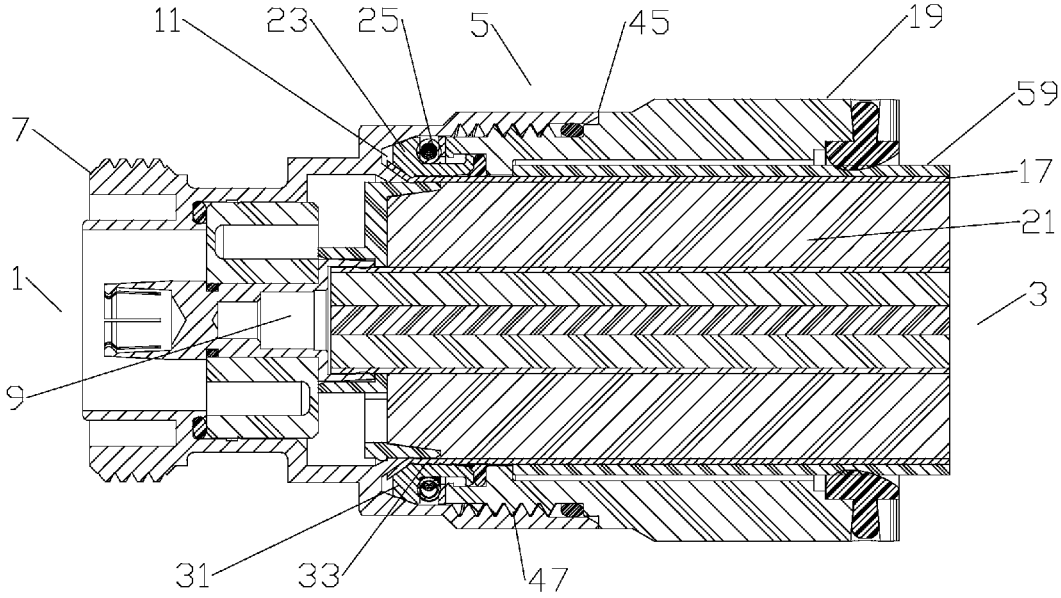
FIG. 3 is a schematic 90 degree cut-away side view of the first embodiment coaxial connector with coaxial cable interconnected.

One skilled in the art will appreciate that the connector end 1 and the cable end 3 are descriptors used herein to clarify longitudinal locations and/or contacting interrelationships between the various elements of the coaxial connector(s). In addition to the identified positions in relation to adjacent elements along the coaxial connector longitudinal axis, each individual element has a connector end side and a cable end side, i.e. the sides of the respective element that are facing the respective connector end 1 and the cable end 3 of the coaxial connector 5. A first embodiment of a coaxial connector, as shown in FIGS. 1-6, includes a connector body 7 provided with a connector body bore 9. As best shown in FIG. 2, an annular coupling groove 11 provided in the connector body bore 3 is open to a cable end 3 of the connector body 7. A clamp sidewall 13 of the coupling grove 11 is angled inward from a bottom 15 of the coupling groove 11, dimensioned as a seat against which a leading edge of the outer conductor 17 is clamped. A coupling body 19 provided with a coupling body bore 21 dimensioned to fit over the outer conductor 17 of the coaxial cable is threadable into the cable end 3 of the connector body 7.

Figure 4:
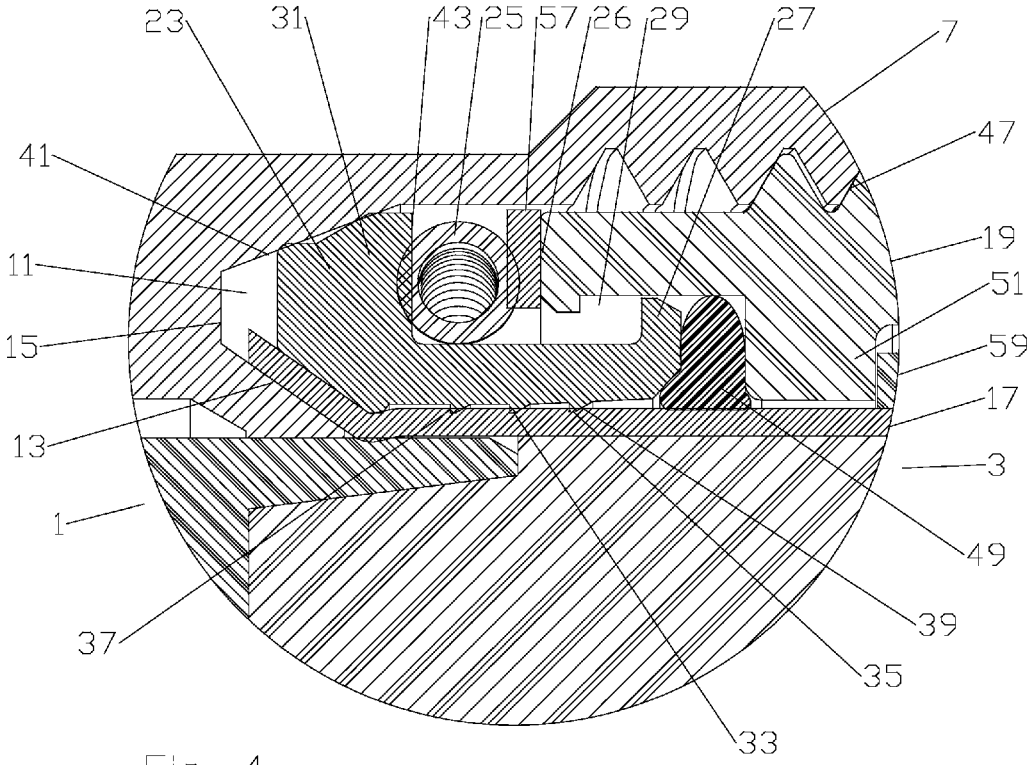
FIG. 4 is a close-up view of FIG. 3.

A slip ring 23 positioned at a connector end 1 of the coupling body 19 is dimensioned to seat within the coupling groove 11. As best shown in FIG. 4, the slip ring 23 may be retained coupled to the coupling body 23 by an outward projecting coupling shoulder 27 at the cable end 3 of slip ring 23 seated within an annular retention groove 29 of the coupling body bore 21.

Figure 5:
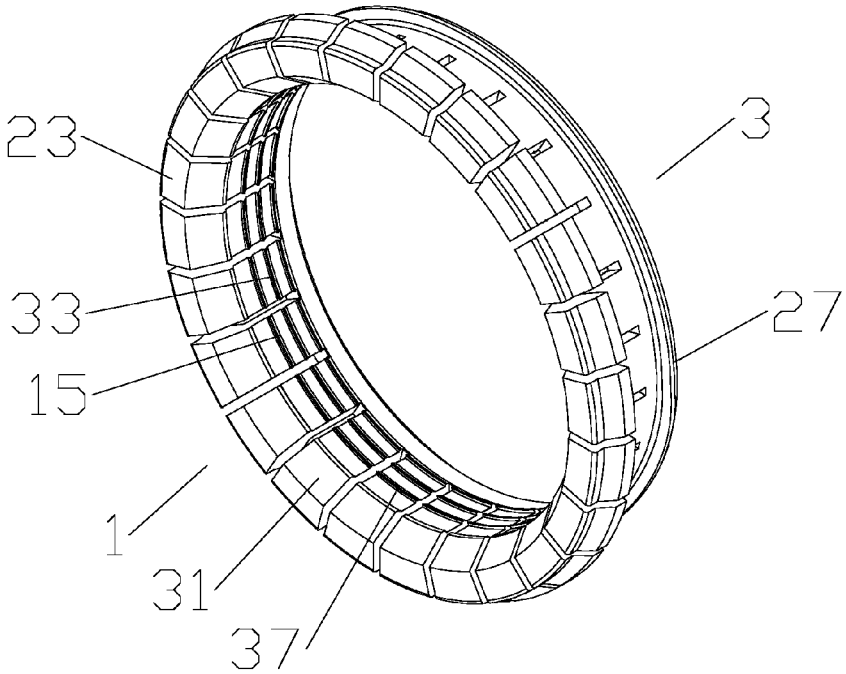
FIG. 5 is a schematic isometric angled cable end view of a slip ring.
Figure 6:
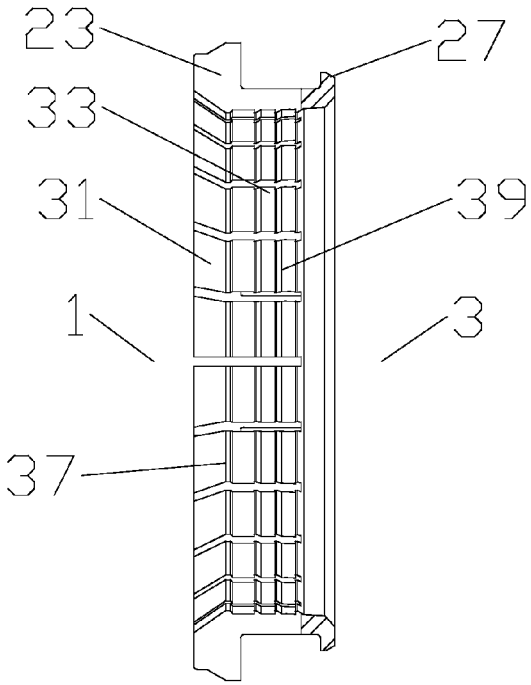
FIG. 6 is a schematic 90 degree cut-away side view of FIG. 5.
Figure 7:
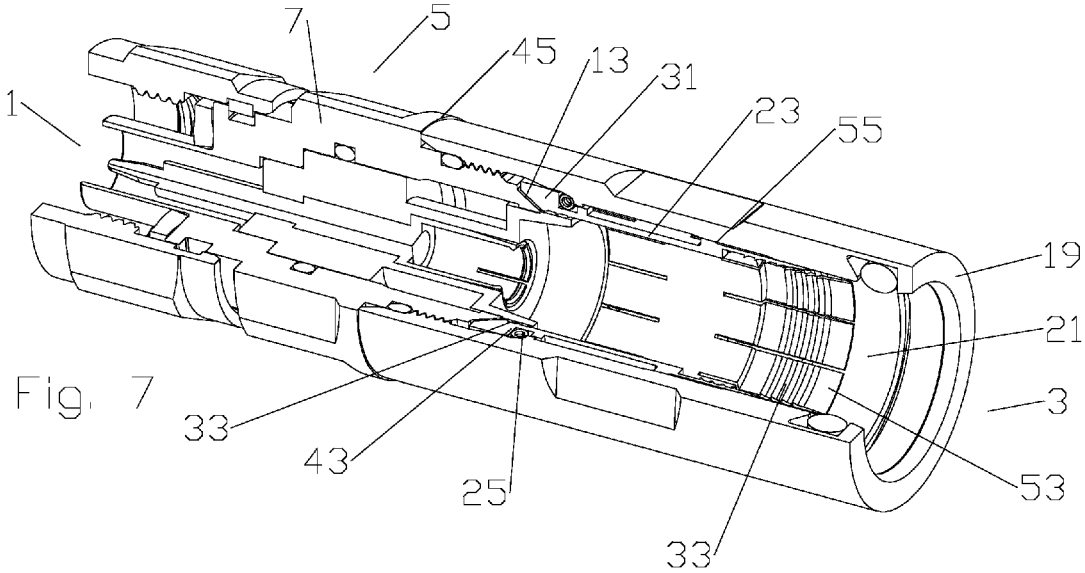
FIG. 7 is a schematic 90 degree cut-away isometric view of a second embodiment of a coaxial connector.

As best shown in FIGS. 5 and 6, the slip ring 23 has a plurality of coupling spring finger(s) 31 extending toward the connector end 1, the inner diameter of the coupling spring finger(s) 31 provided with a grip surface 33. The grip surface 33 may be formed as a plurality of annular barb(s) 35; for example, each of the barb(s) 35 may be provided with a stop surface 37 at a connector end side and an insertion surface 39 at a cable end side, and the stop surface 37 may be provided normal to a longitudinal axis and the insertion surface 39 angled towards the connector end 1. Thereby, the outer conductor 17 may be inserted past the barb(s) 35, spreading the coupling spring finger(s) 31 outward and sliding over the angled insertion surface(s) 39 toward the connector end 1, but the stop surface(s) 37 will bite into and grip the outer diameter surface of the outer conductor 17 if movement towards the cable end 3 is attempted. Alternatively, the grip surface 33 may be formed, for example, as a helical thread.

As the coupling body 19 with attached slip ring 23 is inserted in and threaded into the connector body 7, an outer diameter of the distal end of the coupling spring finger(s) 31 engages a compression sidewall 41 angled outward from the bottom of the coupling groove 11, the decreasing diameter of the compression sidewall 41 driving the coupling spring finger(s) 31 radially inward towards the clamp sidewall 13 and outer conductor 17. Thereby, as best shown in FIG. 4, circumferential reinforcement is provided for the slip ring 23 by the connector body 7, reducing the structural requirements of the slip ring 23 and enabling a corresponding reduction in an outer diameter of the coaxial connector 5. Further, as the coupling spring finger(s) 31 are driven radially inward by the contact with the compression sidewall 41, the grip surface 33 is driven into secure contact with the outer conductor 17.

A compression body 25, for example a helical coil spring ring, is seated on an outer diameter of the coupling slip finger(s) 31, between an upward projecting compression body shoulder 43 and a compression surface 26 of the coupling body 19. A washer 57 may be applied between the compression body 25 and the compression surface 26 to reduce fouling during threading between the coupling body 19 and the connector body 7.

A compression force generated by the axial advance of the coupling body 19 to clamp the leading edge of the outer conductor 17 between the coupling spring finger(s) 31 and the clamp sidewall 13 and also a radial displacement of the grip surface 33 against the outer diameter of the outer conductor 17 may be limited by the application of a surface to surface positive stop 45 (FIG. 3) between the coupling body 19 and the connector body 7 that stops the compression force at a predetermined maximum torque by preventing further movement (threading) of the coupling body 19 toward the connector body 7 once the specific preselected axial positioning between the coupling body 19 and the connector body 7 which is known to generate the desired maximum torque is reached.

The threading between the connector body 7 and the coupling body 19 (FIGS. 1 and 2) may be applied as multiple interleaved thread(s) 47, for example four interleaved threads, increasing the thread pitch to significantly reduce the number of rotations required to advance the coupling body 19 to the positive stop 45 engagement with the connector body 7, without unacceptably reducing the strength characteristics of the resulting threaded interconnection.

An axial play between the coupling shoulder 27 and the retention groove 29 of the coupling body 19 may be utilized to compress a gasket 49 seated between a cable end 3 of the slip ring 23 and an inward projecting gasket shoulder 51 of the coupling body bore 21. Thereby, the outer conductor 17 may be easily inserted through the gasket 49 while in an uncompressed state and then as the coupling body 19 is advanced towards the connector body 7, the slip ring 23 is driven towards the cable end 3 of the retention groove 29, which compresses the gasket 49 against the gasket shoulder 51, deforming it radially inward into secure sealing engagement with the outer diameter of the outer conductor 17 (FIG. 4).

One skilled in the art will appreciate that the combination of leading edge outer conductor clamping with outer conductor gripping via the grip surface 33 may provide improved interconnection strength and/or additional strain relief by distributing stress from the front edge of the outer conductor 17 across the outer diameter of the outer conductor 17.

Figure 8:
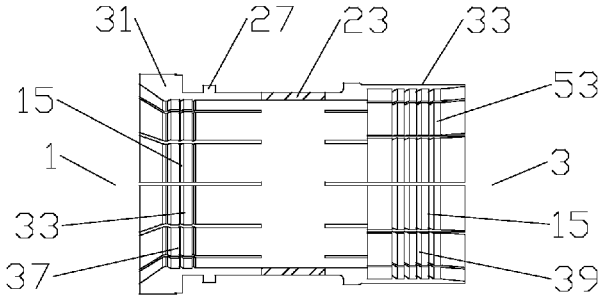
FIG. 8 is a schematic cut-away side view of another slip ring.
Figure 9:
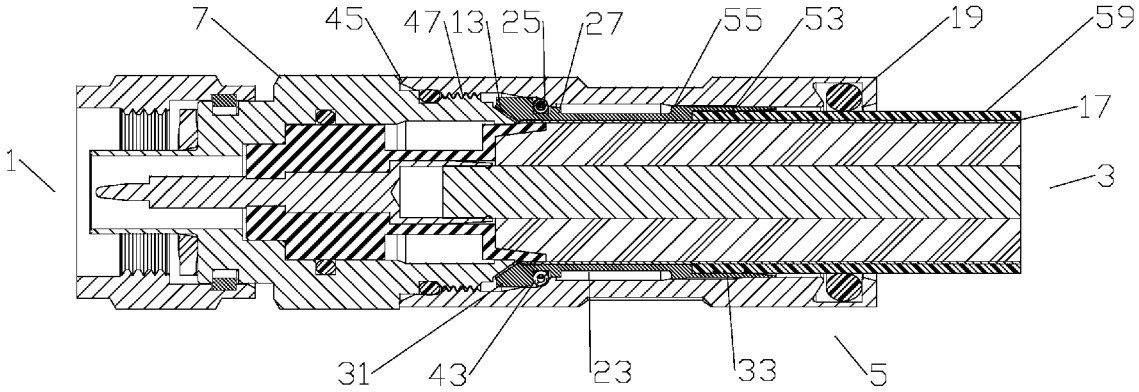
FIG. 9 is a schematic cut-away side view of the coaxial connector of FIG. 7, with a coaxial cable interconnected.
Figure 10:
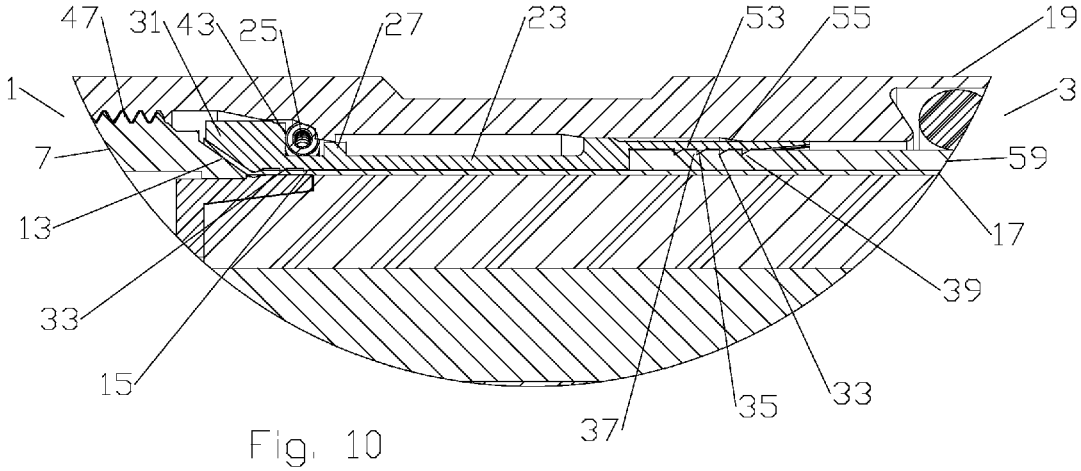
FIG. 10 is a close-up view of FIG. 9.
Figure 11:
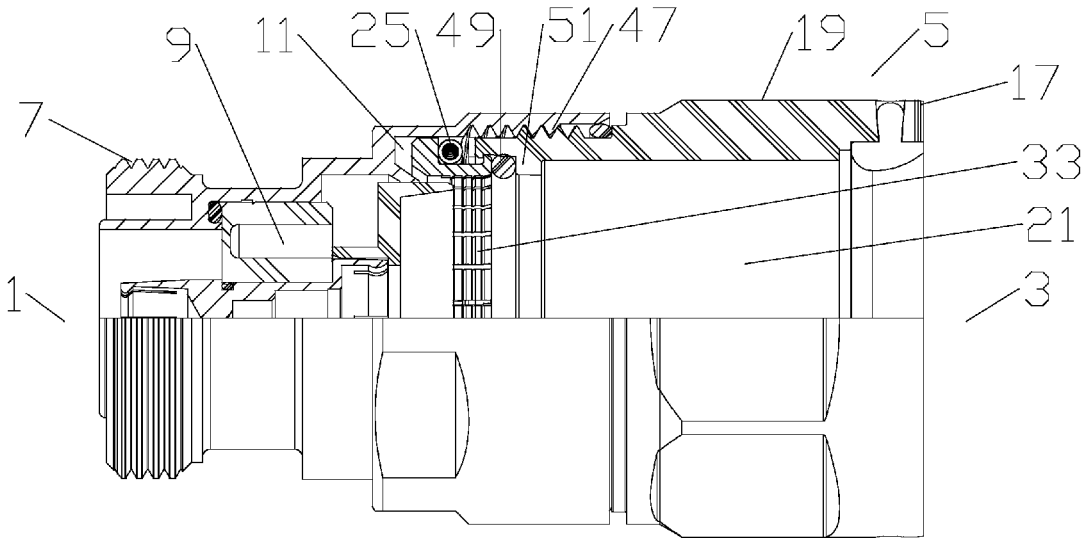
FIG. 11 is a schematic 90 degree cut-away side view of a third embodiment of a coaxial connector.
Figure 12:
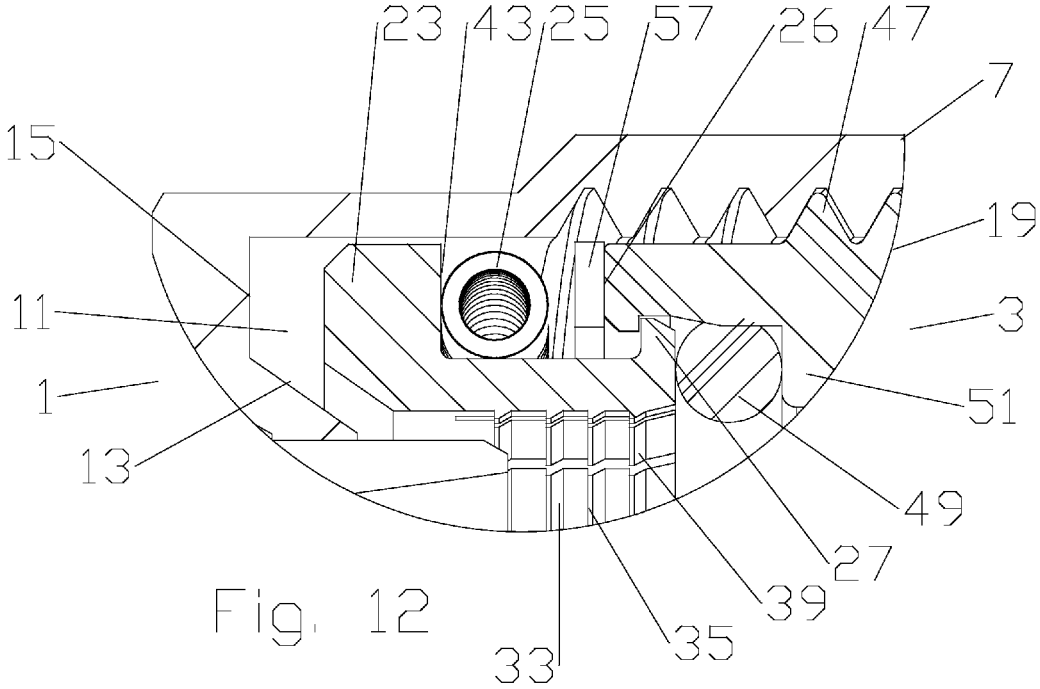
FIG. 12 is a close-up view of FIG. 11.
Figure 13:
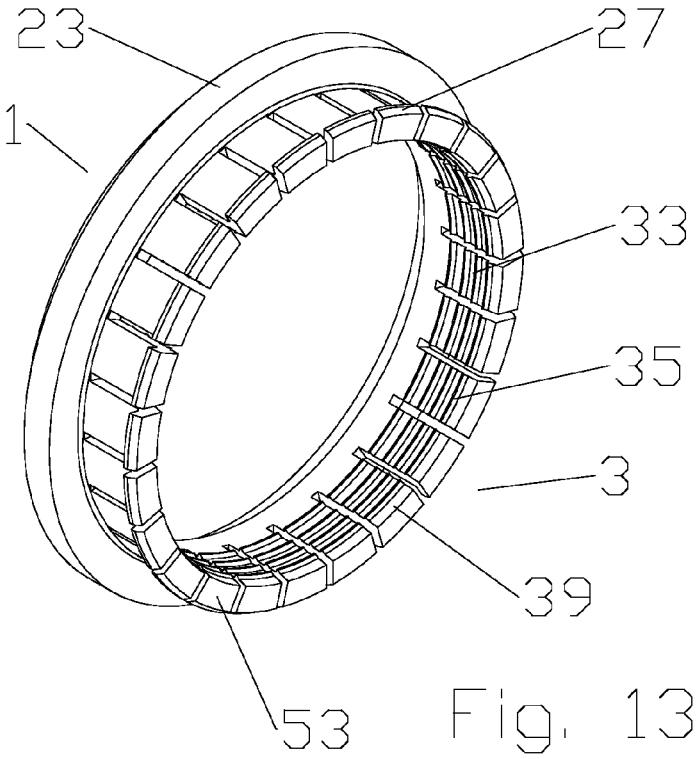
FIG. 13 is a schematic isometric view of another embodiment of a slip ring.
Figure 14:
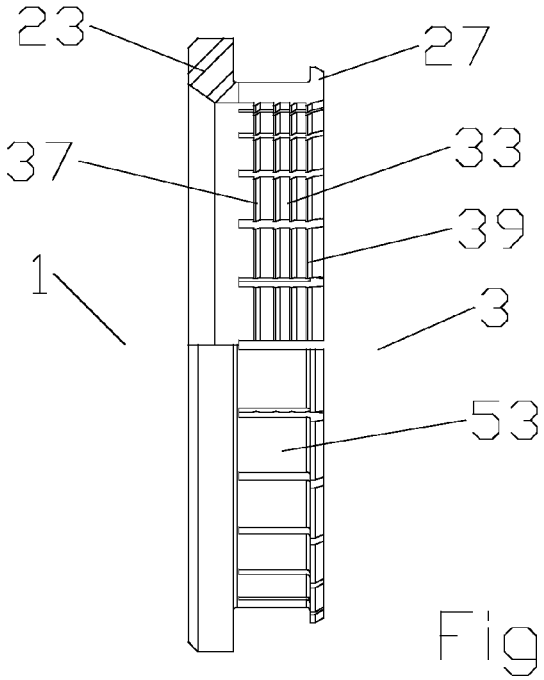
FIG. 14 is a schematic 90 degree cut-away side view of FIG. 13.

One skilled in the art will appreciate that the benefits of the slip ring 23 with grip surface 33 may also be realized in coaxial connector configurations wherein the connector body 7 threads into the coupling body 19, for example as shown in FIGS. 7-10. Also, coaxial cable interconnection strength and stabilization may be further enhanced by providing the slip ring 23 with a plurality of grip spring finger(s) 53 extending from a cable end 3 of the slip ring 23 (FIG. 8). A corresponding inward projecting wedge shoulder 55 of the coupling body bore 9 contacts the grip spring finger(s) 53 to drive another inner diameter grip surface 33 of the grip spring finger(s) 53 radially inward into secure engagement with the jacket 59 of the coaxial cable as the coupling body 19 advances along the thread(s) 47 during interconnection.

Figure 15:
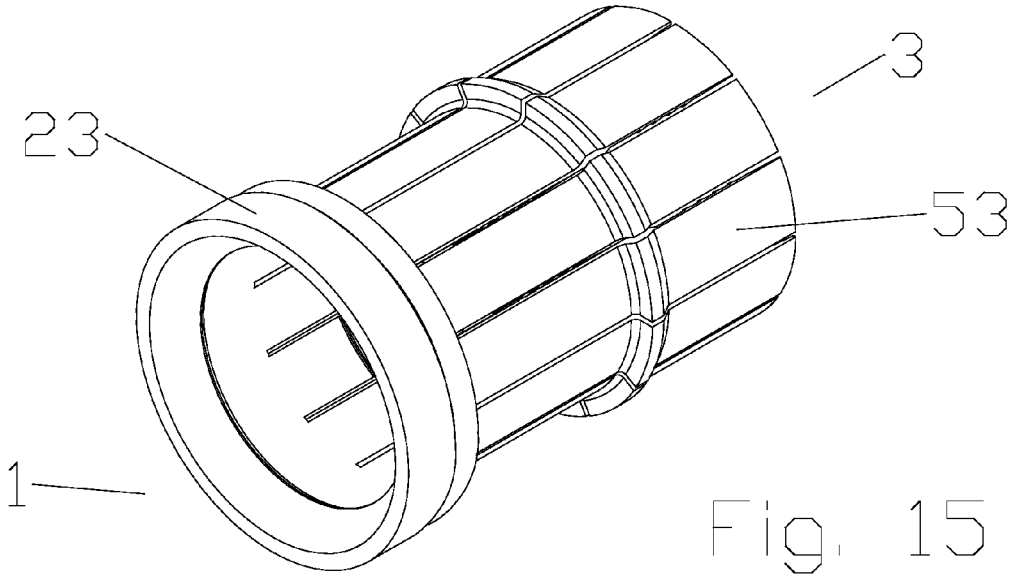
FIG. 15 is a schematic isometric view of an alternative slip ring.
Figure 16:
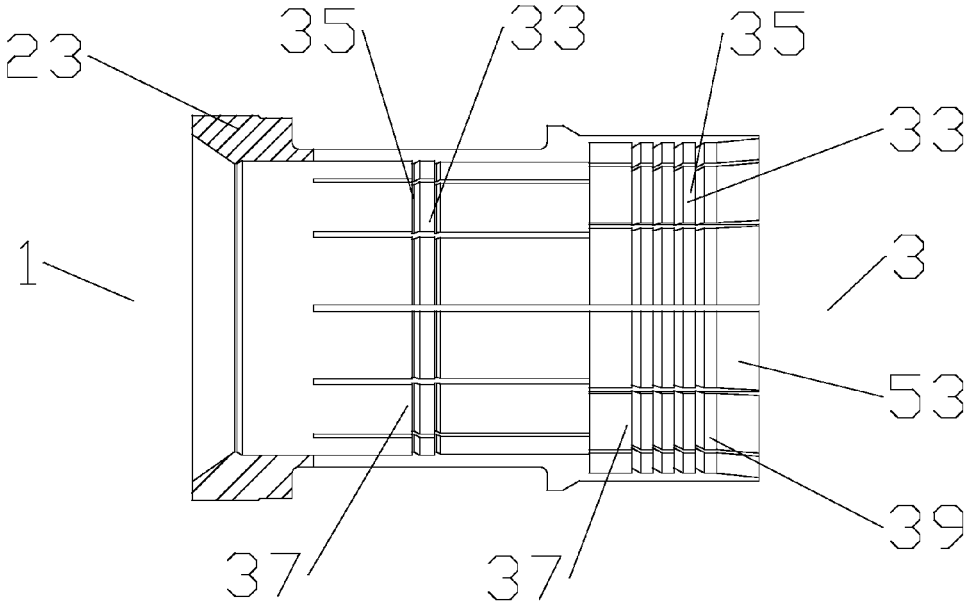
FIG. 16 is a schematic cut-away side view of FIG. 15.

In a further alternative embodiment, the slip ring 23 with grip surface 33 may be applied in a conventional clamp configuration with cable end 3 grip spring finger(s) 53 stabilizing the interconnection with jacket 59, for example as shown in FIGS. 11-14. Similarly, the embodiment of FIGS. 7-10 may be applied with the conventional clamp configuration by exchanging the slip ring 23 with one including a solid connector end and dual grip surface(s) 33, one engaging the outer conductor 17 and the other the jacket 59, for example as shown in FIGS. 15 and 16, applied to the grip spring fingers 53.

Figure 17:
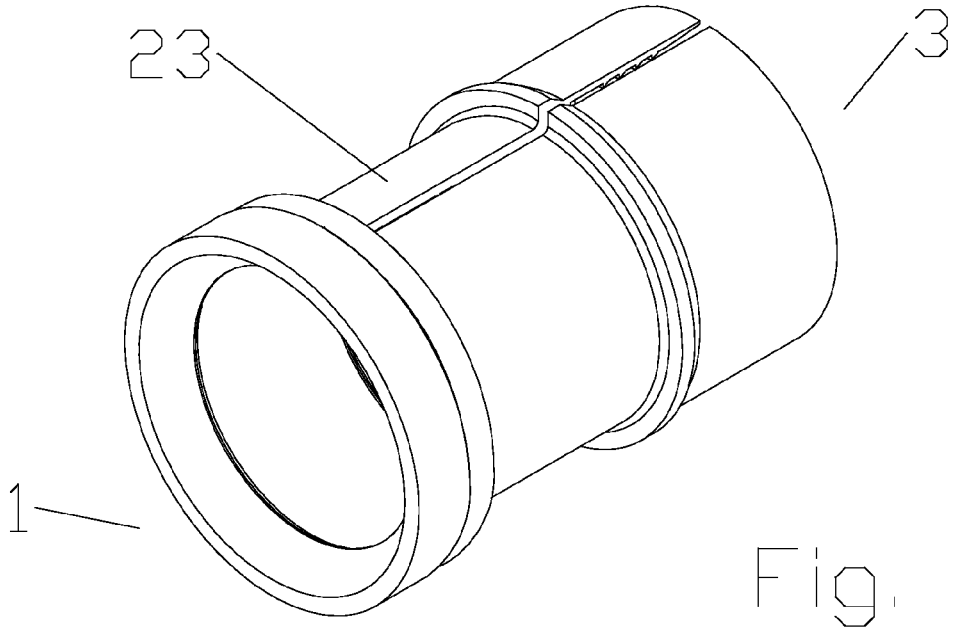
FIG. 17 is a schematic isometric view of another alternative slip ring.
Figure 18:
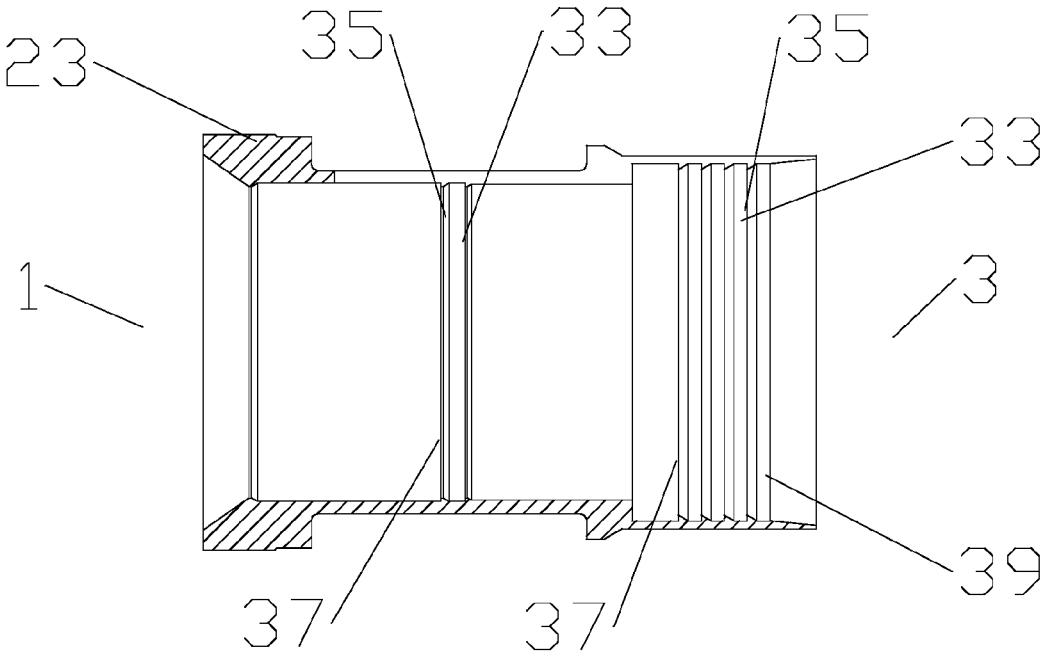
FIG. 18 is a schematic cut-away side view of FIG. 17.
Figure 19:
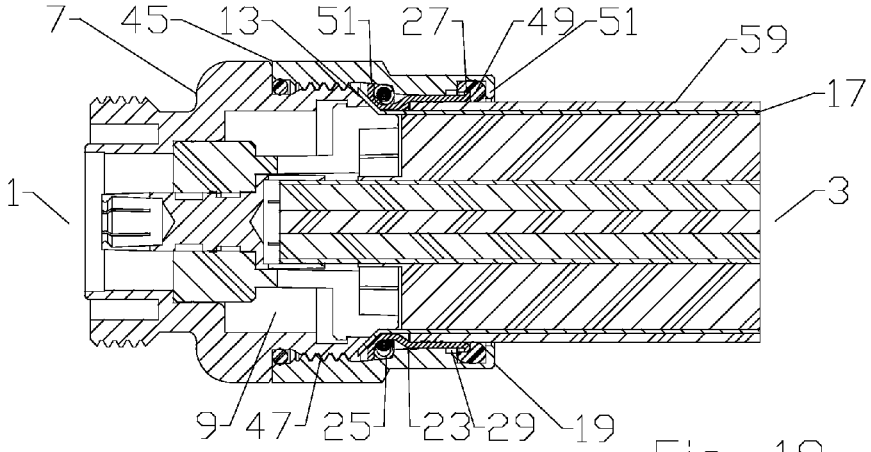
FIG. 19 is a schematic cut-away side view of another embodiment of a coaxial connector.

To simplify manufacture, the slip ring 23 of the various embodiments may be provided in a c-shaped configurations, for example as shown in FIGS. 17 and 18, without coupling spring finger(s) 31 or grip spring finger(s) 53 as applicable, the gap of the c-shape enabling a limited radial inward movement as either end of the slip ring 23 encounters a respective decreasing radius surface.

Figure 20:
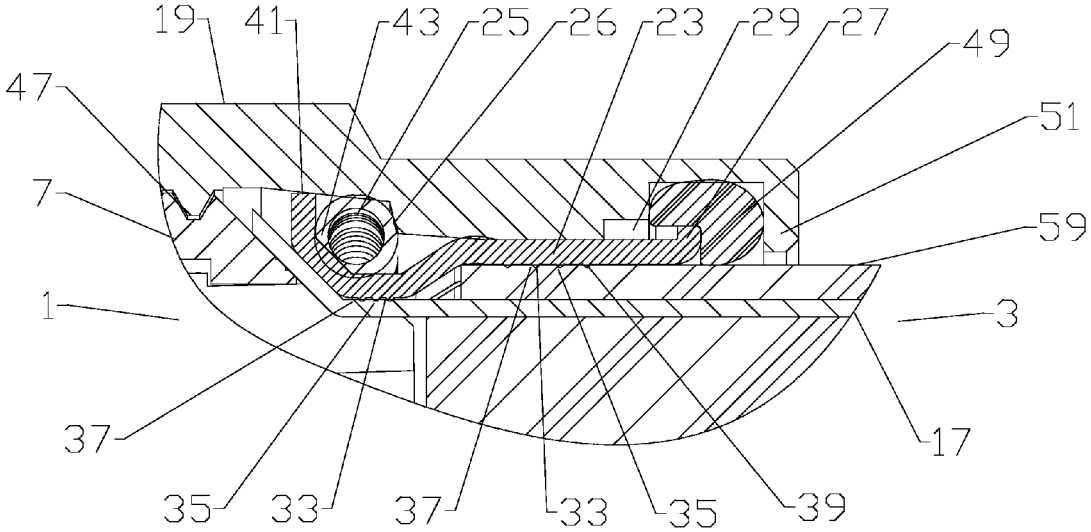
FIG. 20 is a close-up view of FIG. 19.
Figure 21:
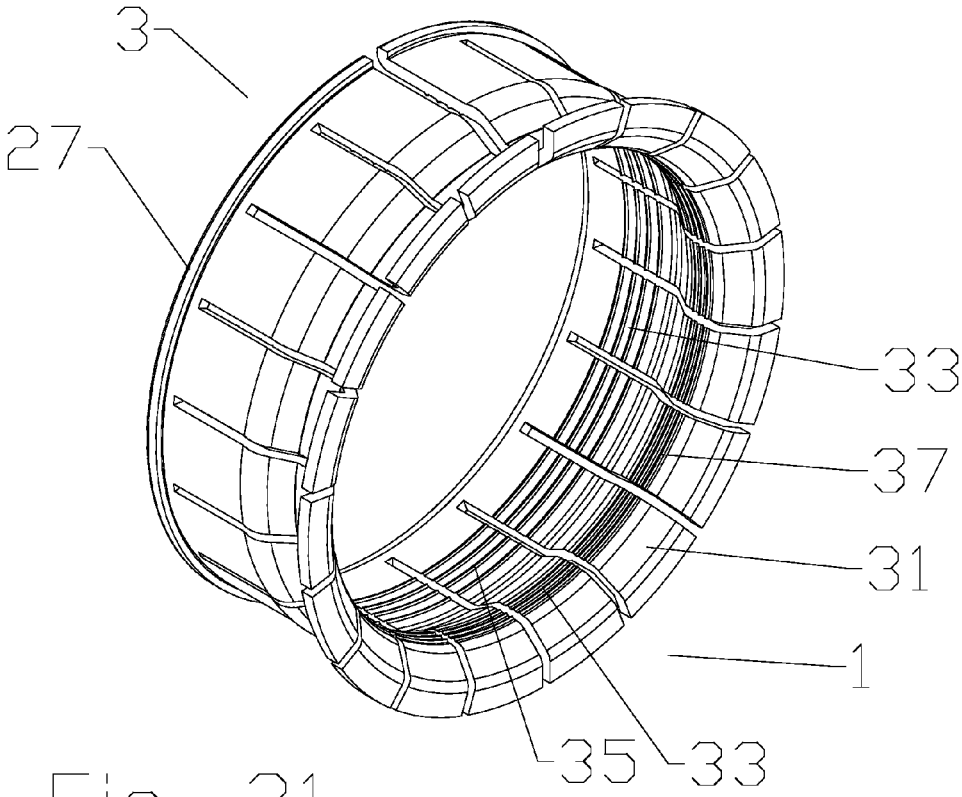
FIG. 21 is a schematic isometric view of another embodiment of a slip ring, as shown in FIG. 19.
Figure 22:
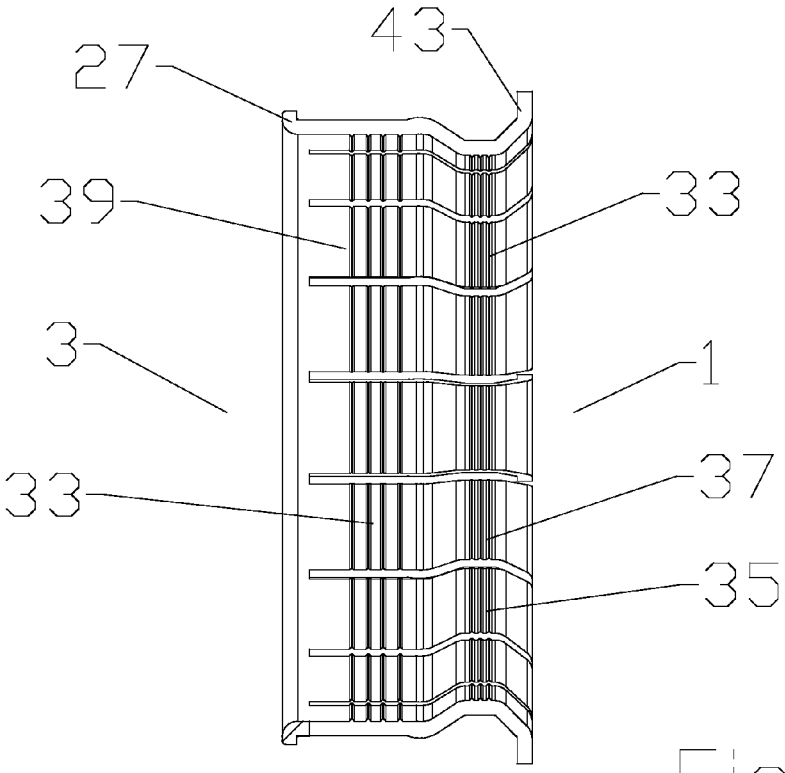
FIG. 22 is a schematic cut-away side view of FIG. 21.

The slip ring 23 may also be formed as a metal stamping rolled into ring form, for example as shown in FIGS. 19-22. As best shown in FIG. 20, an elastic radial inward force characteristic may be obtained by dimensioning a portion of the slip ring 23 to engage the jacket 59, the coupling shoulder 27 biased radial inward by a lower portion of the gasket 49 driven into the cable end 3 of the spring ring 23 as the coupling body 19 is axially advanced towards the connector body 7, whereby as the gasket 49 is deformed within the retention groove 29 around the coupling shoulder 27, the gasket exerts a downward bias upon the coupling shoulder 27 and thus a cable end grip surface 33 of the coupling spring finger(s) 31 is elastically biased radial inward against the jacket 59.

Although the disclosed embodiments are particularly suited for smooth wall solid outer conductor cable, these may also be applied to other solid outer conductor configurations, such as annular corrugated solid outer conductor. An annular corrugated solid outer conductor coaxial cable is prepared by cutting the end at a corrugation peak, which positions the coaxial cable to present a corrugation peak for the sealing gasket to be compressed against and enables the leading edge of the outer conductor to seat against the slip ring lip.

One skilled in the art will appreciate that providing the slip ring 23 pre-attached to the coupling body 19, the compression body 25 protected between the slip ring 23 and the coupling body 19, may significantly decrease the chances for loosing separate elements of the connector prior to assembly and/or improper assembly.

Table of Parts

| | |
|---|---|
| 1 | connector end |
| 3 | cable end |
| 5 | coaxial connector |
| 7 | connector body |
| 9 | connector body bore |
| 11 | coupling groove |
| 13 | clamp sidewall |
| 15 | bottom |
| 17 | outer conductor |
| 19 | coupling body |
| 21 | coupling body bore |
| 23 | slip ring |
| 25 | compression body |
| 26 | compression surface |
| 27 | coupling shoulder |
| 29 | retention groove |
| 31 | coupling spring finger |
| 33 | grip surface |
| 35 | barb |
| 37 | stop surface |
| 39 | insertion surface |
| 41 | compression sidewall |
| 43 | compression body shoulder |
| 45 | positive stop |
| 47 | thread |
| 49 | gasket |
| 51 | gasket shoulder |
| 53 | grip spring finger |
| 55 | wedge shoulder |
| 57 | washer |
| 59 | jacket |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A coaxial connector for use with a coaxial cable with an outer conductor, comprising:

a connector body provided with a connector body bore;

an annular coupling groove provided in the connector body bore open to a cable end of the connector body;

a clamp sidewall of the coupling grove angled inward from a bottom of the coupling groove;

a slip ring seated within the coupling body bore, provided with a plurality of coupling spring fingers extending towards a connector end, an inner diameter of the coupling spring fingers provided with a grip surface; and an annular compression body seated on an outer diameter of the slip ring between a compression surface of the coupling body and an upward projecting compression body shoulder of the coupling spring fingers;

the connector body and the coupling body coupled together via threads;

the slip ring dimensioned for axial advancement of the coupling body along the threads to drive the compression body against the compression shoulder to exert a compression force against a leading edge of the outer conductor to clamp the leading edge of the outer conductor against the clamp sidewall.

2. The coaxial connector of claim 1, further including a surface to surface positive stop between the clamp nut and the connector body that stops the compression force at a predetermined maximum torque by preventing further movement of the clamp nut towards the connector body.

3. The coaxial connector of claim 1, wherein the slip ring is retained within the connector body bore by an outward projecting coupling shoulder at a cable end of the slip ring, the coupling shoulder seated within an annular retention groove of the coupling body.

4. The coaxial connector of claim 1, further including a compression sidewall angled outward from the bottom of the coupling groove;

the coupling spring fingers driven radially inward towards the clamp sidewall by contact with the compression sidewall.

5. The coaxial connector of claim 1, wherein the grip surface is a plurality of annular barbs.

6. The coaxial connector of claim 5, wherein the annular barbs have a stop surface at a connector end and an insertion surface at a cable end; the stop surface provided normal to a longitudinal axis and a diameter of the insertion surface increasing towards the connector end.

7. The coaxial connector of claim 1, wherein the compression body is a helical coil spring ring.

8. The coaxial connector of claim 1, wherein the threads are multiple interleaved threads.

9. The coaxial connector of claim 1, further including a sealing gasket seated between a cable end of the slip ring and an inward projecting sealing gasket shoulder of the coupling body bore.

10. The coaxial connector of claim 1, further including a plurality of jacket grip spring fingers extending from a cable end of the slip ring.

11. The coaxial connector of claim 10, further including a jacket wedge shoulder of the coupling body bore; the jacket wedge shoulder biasing the jacket grip spring fingers radially inward as the coupling body advances along the threads.

12. A coaxial connector for use with a coaxial cable with an outer conductor, comprising:

a connector body provided with a connector body bore;

the connector body provided with an inward angled annular clamp sidewall;

a coupling body with a coupling body bore; a slip ring seated within the coupling body bore; the slip ring provided with a plurality of axially projecting coupling spring fingers, an inner diameter of the coupling spring fingers provided with a grip surface;

the connector body and the coupling body coupled together via threads;

the slip ring dimensioned for axial advancement of the coupling body along the threads to generate a compression force for the coupling spring fingers to clamp a leading edge of the outer conductor against the clamp sidewall.

13. The coaxial connector of claim 12, further including a surface to surface positive stop between the clamp nut and the connector body that stops the compression force at a predetermined maximum torque by preventing further movement of the clamp nut towards the connector body.

14. The coaxial connector of claim 12, wherein the slip ring is retained within the connector body bore by an outward projecting shoulder at the cable end seated within an annular retaining groove of the coupling body.

15. The coaxial connector of claim 14, wherein the outward projecting shoulder is biased inward against the jacket by contact with an elastomeric gasket during the axial advancement.

16. The coaxial connector of claim 12, further including a compression sidewall angled outward from the clamp sidewall;

the spring fingers driven radially inward towards the clamp sidewall by contact with the compression sidewall as the coupling body is advanced towards the connector body.

17. The coaxial connector of claim 12, further including a plurality of jacket grip spring fingers extending from a cable end of the slip ring.

18. The coaxial connector of claim 17, further including a jacket wedge shoulder of the coupling body bore; the jacket wedge shoulder biasing the jacket grip spring fingers radially inward as the coupling body advances along the threads.

19. The coaxial connector of claim 12, wherein the slip ring is c-shaped.

20. The coaxial connector of claim 12, wherein the plurality of coupling spring fingers extend from a connector end of the slip ring.

* * * * *